US010284967B2

(12) United States Patent
Lee et al.

(10) Patent No.: US 10,284,967 B2
(45) **Date of Patent: *May 7, 2019**

(54) HEARING DEVICE, PARTICULARLY HEARING AID

(71) Applicant: SIVANTOS PTE. LTD., Singapore (SG)

(72) Inventors: Chuan Foong Lee, Johor Bahur (MY); Eduardo Jr Bas, Singapore (SG); Hoong Yih Chan, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/716,656

(22) Filed: Sep. 27, 2017

(65) Prior Publication Data

US 2018/0063650 A1 Mar. 1, 2018

Related U.S. Application Data

(63) Continuation of application No. 15/075,417, filed on Mar. 21, 2016, now Pat. No. 9,883,293.

(30) Foreign Application Priority Data

Mar. 19, 2015 (DE) ..... 10 2015 204 996

(51) Int. Cl.

| | |
|---|---|
| ***H04R 25/00*** | (2006.01) |
| ***H04R 23/00*** | (2006.01) |
| *H04R 3/14* | (2006.01) |

(52) U.S. Cl.

CPC ..... *H04R 25/405* (2013.01); *H04R 23/002* (2013.01); *H04R 25/456* (2013.01); *H04R 25/48* (2013.01); *H04R 3/14* (2013.01); *H04R 25/604* (2013.01); *H04R 2225/49* (2013.01); *H04R 2225/63* (2013.01); *Y10S 977/00* (2013.01)

(58) Field of Classification Search

CPC .. H04R 25/00; H04R 25/60; H04R 2225/023; H04R 2225/025

USPC ..... 381/312, 316, 324, 328

See application file for complete search history.

(56) References Cited

U.S. PATENT DOCUMENTS

| | | | | |
|---|---|---|---|---|
| 8,019,097 | B2 | 9/2011 | Jiang | H04R 23/002 381/164 |
| 8,401,212 | B2 * | 3/2013 | Puria | H04R 25/405 381/318 |
| 9,467,761 | B2 * | 10/2016 | Grinker | H04R 1/1058 |
| 2006/0159298 | A1 | 7/2006 | Von Dombrowski et al. | |
| 2007/0291971 | A1 | 12/2007 | Halteren | |
| 2010/0195858 | A1 | 8/2010 | Rasmussen et al. | |
| 2015/0382094 | A1 | 12/2015 | Grinker | H04R 1/1058 381/380 |

* cited by examiner

*Primary Examiner* — Suhan Ni

(74) *Attorney, Agent, or Firm* — Laurence A. Greenberg; Werner H. Stemer; Ralph E. Locher

(57) ABSTRACT

A hearing device, particularly a hearing aid, has a housing, a signal processing unit arranged in the housing, a first sound generator disposed in the housing, and a second sound generator. The first sound generator and the second sound generator are configured to convert an output signal from the signal processing unit into sound. The second sound generator is a thermo-acoustic transducer.

8 Claims, 2 Drawing Sheets

HEARING DEVICE, PARTICULARLY HEARING AID

CROSS-REFERENCE TO RELATED APPLICATION

This application is a continuation, under 35 U.S.C. § 120, of copending patent application Ser. No. 15/075,417, filed Mar. 21, 2016; the application also claims the priority, under 35 U.S.C. § 119, of German patent application DE 10 2015 204 996.5, filed Mar. 19, 2015; the prior applications are herewith incorporated by reference in their entirety.

BACKGROUND OF THE INVENTION

Field of the Invention

The invention relates to a hearing device, particularly a hearing aid, comprising a housing, a signal processing unit arranged in the housing and a first sound generator that is arranged in the housing. The first sound generator is configured to convert an output signal from the signal processing unit into sound.

In a hearing aid that has a microphone and an electro acoustic transducer, mechanical vibrations brought about by the electro acoustic transducer can lead to instability in the signal path. By way of example, the vibrations can be recorded by the microphone by dint of acoustic feedback and converted into an electrical signal that, following amplification, is supplied to the electro acoustic transducer and converted into sound by the latter. This forms a closed loop in which the vibrations are amplified to an ever greater extent. As a result, there is the threat of instability in the system, which manifests itself in amplification of undesirable signal components that can exceed the maximum load of individual components of the hearing aid or the pain threshold of a user of the hearing aid.

In particular, not just purely electro acoustic feedback of a sound signal reproduced by the electro acoustic transducer into the signal path via the microphone is relevant in this case. Mechanical vibrations in the electro acoustic transducer, which can result from resonant excitation of the housing surrounding the electro acoustic transducer in the hearing aid, for example, are also able to enter the electrical signal path in the event of inadequate acoustic shielding of the microphone from the vibrations by the hearing aid. Amplification in the signal processing of the hearing aid and reproduction via the electro acoustic transducer mean that the frequencies corresponding to the mechanical vibrations can additionally amplify the vibrations that originally generate them. This electro acoustic feedback likewise excites the mechanical vibration in a resonant manner. In this case, the excitation is effected all the more powerfully the greater the gain of the signal in the signal processing.

Owing to the dimensions of standard hearing aids and the resultant resonant properties, frequencies between 1 kHz and 12 kHz are particularly affected by the electro acoustic amplification and resonant feedback of mechanical vibrations. A sufficiently high gain for a signal prior to sound generation is important particularly for frequencies between 2 kHz and 4 kHz, however. Since particularly important formants for identifying consonants occur in this frequency band, good reproduction dynamics, that is to say particularly an output level that is as high as possible, is important specifically for speech intelligibility. The hearing aid thus needs to allow sound generation that is as loud as possible in this frequency band in order to be able to produce a sound pattern that is as rich as possible during reproduction of voice.

Usually, test series and appropriate algorithms are therefore used to attempt to ascertain, for various frequencies, the maximum gain at which instability in the signal path as a result of resonant excitation is still prevented. However, the maximum gain and hence a rich sound pattern have narrow limits set by the mechanical circumstances of the hearing aid even with such frequency-dependent optimization of the gain toward the respective stability limit. Test series of this kind additionally require the nonlinear effects that may arise in real situations to be taken into account for the resonant excitation so as not to mistakenly estimate the still admissible gain factor as too high, which in practice would promote instability. A conservative assessment, on the basis of the cited considerations, of the still admissible gain at a respective frequency additionally limits the dynamics of reproduction, however.

SUMMARY OF THE INVENTION

It is accordingly an object of the invention to provide a hearing device which overcomes the above-mentioned and other disadvantages of the heretofore-known devices and methods of this general type and which allows the highest possible reproduction dynamics over a broad frequency spectrum during sound generation and at the same time is meant to have a compact design and also the lowest possible susceptibility to mechanical vibrations.

With the foregoing and other objects in view there is provided, in accordance with the invention, a hearing device, comprising:

a housing;

a signal processing unit disposed in the housing and having an output for carrying an output signal;

a first sound generator arranged in the housing;

a thermo-acoustic transducer forming a second sound generator, the first and second sound generators being configured to convert an output signal from the signal processing unit into sound;

a frequency filter having a signal input connected to receive the output signal from the signal processing unit, a low-frequency output connected to the first sound generator, and a high-frequency output connected to the second sound generator.

The hearing device is, in particular, a hearing aid.

In other words, the invention achieves the above objects by means of a hearing device, particularly a hearing aid, comprising a housing, a signal processing unit arranged in the housing, a first sound generator that is arranged in the housing and a second sound generator, wherein the first sound generator and the second sound generator are each set up to convert an output signal from the signal processing unit into sound, and wherein the second sound generator comprises a thermo-acoustic transducer. In addition, the hearing device comprises a frequency filter having a signal input, a low-frequency output and a high-frequency output, wherein the signal input connects the signal processing unit to the frequency filter for the purpose of supplying the output signal, and wherein the low-frequency output is connected to the first sound generator and the high-frequency output is connected to the second sound generator.

In this case, the invention is based on a hearing device that has a housing, a signal processing unit arranged in the housing and a sound generator that is arranged in the housing and that is set up to convert an output signal from the signal processing unit into sound. In particular, the sound generator is in the form of an electro acoustic transducer in this case.

In a first step, the invention recognizes that for the highest possible reproduction dynamics in a broad frequency spectrum, frequency-dependent attenuation of the signal levels to prevent vibrations is counterproductive, since the missing dynamics in the relevant frequency bands impairs sound quality such that this cannot be corrected by other measures. The aim is therefore to attempt to prevent the occurrence of vibrations by means of design measures rather than by regulating the gain.

In this case, the vibrations to be prevented occur essentially first of all as vibrations in the housing surrounding the sound generator, which housing picks up vibration energy, originating from sound generation, from the sound generator, for example as a result of inadequately damped suspension for the sound generator, and this excites the housing in accordance with its resonance properties. For reasons of space, however, the damping of the suspension can be improved only to a restricted degree. In particular, such adjustment of the damping is sufficiently effective only for particular frequency bands in the case of a compact design, since firstly the damping effect is frequency-dependent given a prescribed elasticity of a damper, and secondly the relevant damping constants for the suspension are dependent on the dimensions thereof.

The suppression of coupling of vibration energy generated by the sound generator into the housing surrounding the latter therefore cannot be achieved for arbitrarily wideband frequency spectra under the design conditions. Since, however, specifically in the frequency band from 2 kHz to 4 kHz, a particularly high level of dynamics is desirable in the reproduction of signals in order to achieve a high level of speech intelligibility, one could be inclined to provide a second sound generator and to configure the suspension thereof such that vibrations are damped particularly effectively in this frequency band. This would allow a particularly high signal gain to be applied in said frequency band. In this case, the second sound generator would need to be designed particularly for high reproduction power in this frequency band. The first sound generator—that is to say the one already present originally—could then be designed for lower frequency bands, for example, and the suspension of the first sound generator could be produced particularly for damping low-frequency vibrations.

This can be implemented only with difficulty against the background of the desired compact design, however. Even if the second sound generator is provided with compact dimensions, its physical integration into a hearing device in which a further sound generator is provided cannot readily be accomplished, not least against the background of the required damping suspension of the two sound generators. Moreover, the maximum sound pressure that can be produced by means of a sound generator—and thus also the reproduction dynamics that can be achieved thereby—is usually also dependent on dimensions. An excessive decrease in the size of the second sound generator would in turn result in an unsatisfactory sound pattern in the frequency bands for which the second sound generator would be particularly provided in the first place.

By contrast, the invention proposes that the second sound generator comprises a thermo-acoustic transducer. This allows particularly compact sound generation particularly at higher frequencies with a high level of reproduction dynamics.

While the sound generation in a hearing device is usually effected by electro acoustic transducers, the use of a thermo-acoustic transducer in the second sound generator in this case initially has the advantage that the latter does not generate vibration energy during sound generation. A thermo-acoustic transducer involves an electrical signal being used to produce a sound signal by virtue of the electrical signal producing temperature fluctuations on a face or a surface of the thermo-acoustic transducer. These quickly oscillating temperature fluctuations on the face or surface of the thermo-acoustic transducer result in a time-variant temperature gradient in the adjoining air layers. This time-variant temperature gradient can set the adjoining air layers oscillating, the oscillations propagating as a sound signal.

Such sound generation does not require, and also has no provision for, proper motion, of whatever kind, of the thermo-acoustic transducer. The sound generation by the thermo-acoustic transducer therefore gives rise to no vibrations that can be output to the surroundings or to a suspension. This is relevant in the case of a sound generator for a hearing device, particularly against the background that the dimensions that are usually used lead, particularly for the housing and the suspension of the sound generator, to a resonance spectrum that can easily result in instability of the system as a result of mechanical vibration in frequency ranges above 1 kHz. A sound generator with a thermo-acoustic transducer, particularly one that is suitable, in terms of its dimensioning, for arrangement in a hearing device, additionally has a particularly dynamic reproduction response for frequencies above 1 kHz.

Since the sound generation by the second sound generator thus does not involve any vibration energy being generated that can couple into the housing via a suspension and reach the microphone in said housing, certain instabilities caused by vibrations are effectively prevented. The particularly high level of dynamics when frequencies in the range above 1 kHz are reproduced means that this increase in system stability can be achieved without expected losses in sound quality.

In the present case, a low-frequency output is intended to be understood to mean an output at which signal components of a signal that is input into the frequency filter via the signal input are output such that from a first cutoff frequency, the signal level decreases up to a second cutoff frequency, and from the second cutoff frequency, a significant signal level can no longer be registered. A high-frequency output is accordingly defined as an output at which signal components are output that have a significant signal level only above a third cutoff frequency. In this case, the third cutoff frequency is preferably distinctly below the second cutoff frequency and particularly preferably in the region of the first cutoff frequency so that a sufficient overlap in the frequency responses of the low-frequency output and the high-frequency output is assured.

Preferably, the frequency filter is in this case set up such that the frequency response of the low-frequency output is geared to the frequency response of the first sound generator, and that the frequency response of the high-frequency output is geared to the frequency response of the second sound generator, that is to say of the thermo-acoustic transducer. The use of such a frequency filter allows operation of the first sound generator and the second sound generator, which is in the form of a thermo-acoustic transducer, using a shared output signal from the signal processing unit, which means that the latter requires only one signal output.

Expediently, the thermo-acoustic transducer comprises at least one film formed from carbon nanotubes that is connected to at least one signal port, wherein application of a signal voltage to the or each signal port brings about time-variant heating in the or each film, which heating produces a sound by means of the thermo-acoustic effect. In such a film, the carbon nanotubes may be oriented largely parallel to one another, and even multiple layers of bundles of carbon nanotubes that are parallel to one another, with the orientations of the carbon nanotubes of two successive layers being orthogonal in relation to one another, is possible in this case.

The described microstructure of the film allows largely unhampered propagation of a sound through the film. This allows arrangement of the second sound generator between the first sound generator and a sound output from which the sound signal generated is conveyed to the ear of a user, e.g. by means of a sound conductor and/or an earmold. A thermo-acoustic transducer having a carbon nanotube film may moreover have particularly compact dimensions under the conditions of the desirable sound reproduction.

Advantageously, the second sound generator is arranged in the housing. Such positioning simplifies the connection of the second sound generator to the signal processing unit. In principle, however, it is also possible for the second sound generator to be arranged in a sound conductor that can be connected to the hearing device and that is used to convey a generated sound signal to the ear of a user. Such an approach allows a further reduction in the size of the hearing device.

In one advantageous refinement of the invention, the first sound generator is designed such that it has a higher maximum reproduction level for frequencies in a frequency range up to 4 kHz, preferably up to 2 kHz, than for frequencies above this frequency range. In this case, the maximum reproduction level can be correlated to the maximum sound pressure that can be produced. In particular, the frequency response of the first sound generator can decrease from a first cutoff frequency below 4 kHz, preferably below 3 kHz, and can have complete cutoff at a second cutoff frequency, preferably above 4 kHz, particularly above 6 kHz. While a thermo-acoustic transducer, particularly one that is suitable, in terms of its dimensions, for arrangement in a hearing device, is designed particularly for sound generation of frequencies above 1 kHz, and in this case needs to have a maximum reproduction level preferably in the range between 2 kHz and 4 kHz, a first sound generator that reaches its maximum reproduction level in lower frequency bands can, in combination with the second sound generator, contribute to a complete sound pattern.

In a preferred embodiment, the housing has an acoustic space formed in it with a sound output, wherein the first sound generator is configured to generate sound in the acoustic space, and wherein the second sound generator is arranged in the acoustic space. In this embodiment, the sound generated can be conveyed to the ear of a user via the sound output and possibly a sound conductor and/or an earmold. Sound generation by the first sound generator in the acoustic space is intended to be understood in this context to mean that a substantial proportion of the sound power produced can be registered as sound pressure in the acoustic space, with radiation into other regions of the hearing device not being precluded. Such an arrangement allows particularly a modular design for the hearing device, in which the first sound generator, the second sound generator, the corresponding suspensions and signal connections and, if present, a frequency filter can be combined to produce a module in an interior housing that surrounds said components. In this case, the acoustic space is formed in the interior housing. The modular design allows the remaining components of the hearing device—e.g. the signal processing unit or the or each microphone—to be designed and constructed independently of the sound generators.

Advantageously, the second sound generator is in this case arranged in the sound path between the first sound generator and the sound output. In this context, the sound path between the first sound generator and the sound output is intended to be understood to mean the primary—that is to say as reflection-free as possible—path along which a sound signal generated by the first sound generator propagates to the sound output. Such an arrangement firstly allows a particularly compact design, and secondly this makes optimum use, particularly if the second sound generator has a film comprising carbon nanotubes, of the microstructure of the thermo-acoustic transducer, which microstructure allows almost unhampered propagation of a sound signal through the film.

Alternatively, the second sound generator is arranged preferably to the side of the sound path between the first sound generator and the sound output. In this case, the selection of the positioning of the second sound generator can be made dependent particularly on its dimensioning and on the desired individual spectral properties with regard to reproduction dynamics.

In an additionally advantageous refinement of the invention, the hearing device comprises a third sound generator that is set up to convert an output signal from the signal processing unit into sound, wherein the third sound generator comprises a thermo-acoustic transducer. In particular, the third sound generator may be different than the second sound generator, and in particular the third sound generator can have a different frequency response than the second sound generator. This allows further improvement in the sound quality for constant vibration suppression, since the sound spectrum that can be produced can be additionally differentiated for the individual sound generators.

Expediently, the hearing device comprises a sound conductor that is reversibly connectable to the housing and that has a number of signal ports, wherein the second sound generator and/or the third sound generator is arranged in the sound conductor, and wherein in the state in which the sound conductor is connected to the housing, the number of signal ports of the sound conductor produces a signal connection from the signal processing unit to the second and third sound generators. A sound generator arranged in a sound conductor and having a thermo-acoustic transducer allows the spectral properties of the sound conductor to be utilized to improve reproduction dynamics.

Other features which are considered as characteristic for the invention are set forth in the appended claims.

Although the invention is illustrated and described herein as embodied in a hearing device, particularly hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
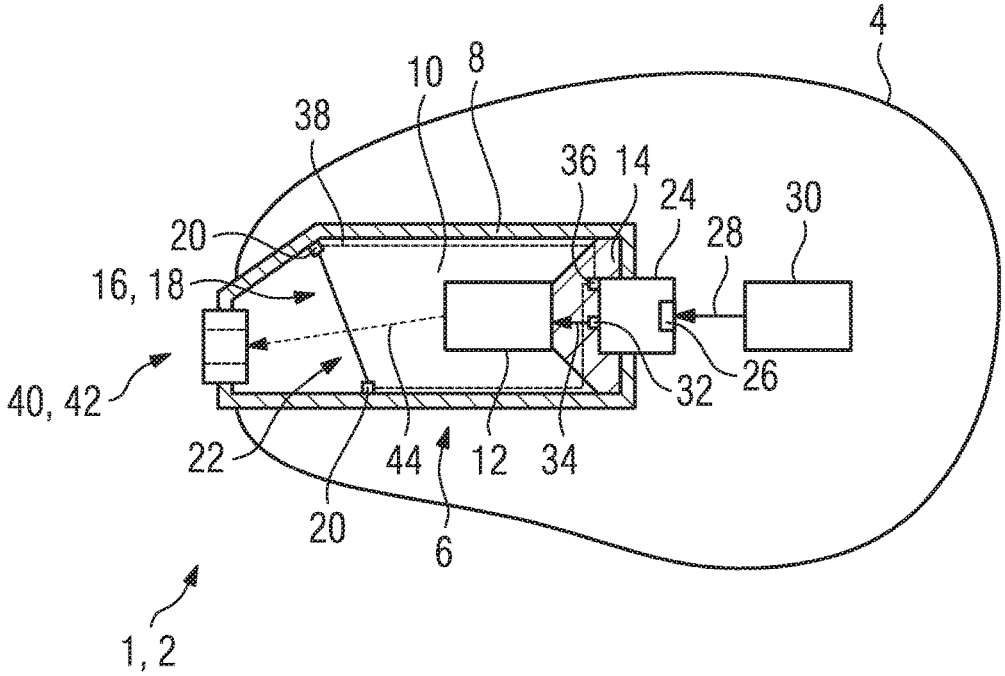
FIG. 1 shows a schematic sectional illustration of a hearing device having a conventional transducer and a thermo-acoustic transducer.

Referring now to the figures of the drawing in detail and first, particularly, to FIG. 1 thereof, there is shown, in a schematic sectional illustration, a hearing device 1 that, in this case, is in the form of a hearing aid 2. The hearing device 1 comprises a housing 4 in which a modular unit 6 has been inserted. The modular unit 6 has an interior housing 8 that surrounds, or encases, an acoustic space 10. The interior housing 8 of the modular unit 6 contains a first sound generator 12 on a damping suspension 14. In this case, the first sound generator 12 is in the form of a conventional, electro-acoustic transducer. In addition, the interior housing 8 of the modular unit 6 contains a second sound generator 16 that is in the form of a thermo-acoustic transducer 18. The second sound generator 16 has two signal terminals, or ports 20 and a film 22 comprising carbon nanotubes. The film 22 may also be referred to as a nanotube sheet 22.

To generate a sound signal, the interior housing 8 first of all contains a signal filter, or signal splitter 24 having a signal input 26 for receiving an output signal 28 from a signal processing unit 30. From a low-frequency output 32 of the signal filter 24, a low-frequency connection 34 is routed to the first sound generator 12. In addition, the signal filter 24 has a high-frequency output 36, from which high-frequency connections 38 are routed to each of the signal ports 20 of the thermo-acoustic transducer 18. The output signal 28 that is output by the signal processing unit 30 is broken down into a low-frequency component and a high-frequency component in the signal filter 24.

The low-frequency component of the output signal 28 is output at the low-frequency output 32, via the low-frequency connection 34, to the first sound generator and converted by the latter into sound having predominantly low frequencies. In this case, the sound generated by the first sound generator 12 propagates primarily in the acoustic space 10 to a sound output 40, which forms a sound path 44. In this case, the sound output 40 has a rubber connecting piece 42 onto which a sound conductor, e.g., a sound tube, which is not shown in more detail, can be fitted for conveying the sound generated in the acoustic space 10 to a further earmold and ultimately to the eardrum of the user of the hearing device.

The high-frequency signal component of the output signal 28 is output at the high-frequency output 36, via the respective high-frequency connections 38, to the thermo-acoustic transducer 18 and converted by the latter into sound having predominantly high frequencies. In this case, the arrangement of the thermo-acoustic transducer 18 in the sound path 44 of the first sound generator 12 has no significant effects on the sound from the first sound generator 12 and the propagation thereof on account of the microstructure of the carbon nanotube film 22.

The first sound generator 12 is designed as an electro-acoustic transducer for powerful sound generation up to frequencies of 3 kHz, and above these frequencies, the reproduction spectrum decreases continuously up to complete cutoff at approximately 6-7 kHz. The thermo-acoustic transducer 18 is designed for particularly powerful sound generation in the range from approximately 1 kHz to 15 kHz. The acoustic design of the reproduction power of the thermo-acoustic transducer 18 has a certain degree of freedom, but the lower limit—that is to say the frequency from which the thermo-acoustic transducer is able to produce a significant sound pressure—for the frequency range needs to be chosen such that a significant overlap with the reproduction spectrum of the first sound generator 12 is assured, and the upper limit—from which the sound pressure that can be produced decreases—is dependent primarily on the frequencies that are still desired and/or required for the respective application.

Since the output signal 28 is split by the signal filter 24 into a low-frequency component and a high-frequency component that are each converted into sound by different sound generators, the gains for corresponding frequency bands can be optimized in the signal processing unit 30 to the effect that the most dynamic reproduction possible is obtained for the lowest possible feedback into a microphone, which is not shown in more detail in the drawing, of the hearing device 1. The damping suspension 14 of the first sound generator 12 can firstly partially absorb mechanical vibrations in the first sound generator. The first sound generator can furthermore be optimized for operation with the least vibration possible in the low-frequency range.

Such optimization of operation is in most cases possible only for particular, restricted frequency bands owing to the mechanical complexity of sound generators that are typically used in a hearing device. The use of a first sound generator 12 and of a second sound generator 16 now firstly allows the first sound generator to be optimized in terms of its reproduction and vibration properties in the low-frequency range, and allows the second sound generator to be optimized for maximum gain in particular higher frequency bands—e.g. in the range from 2 kHz to 4 kHz that is relevant for speech intelligibility.

The arrangement of a second sound generator 16 in a hearing device 1 is usually unimplementable for reasons of space. The use of a thermo-acoustic transducer 18 means that said thermo-acoustic transducer is possible, however, in combination with a conventional, electro acoustic transducer, as exists in the first sound generator 12. Owing to the microstructure of the film 22 comprising carbon nanotubes, which microstructure equates to a fine tissue through which the sound from the first sound generator 12 can propagate, there are also no restrictions for the arrangement of the thermo-acoustic transducer 18 in relation to the sound path 44.

Figure 2:
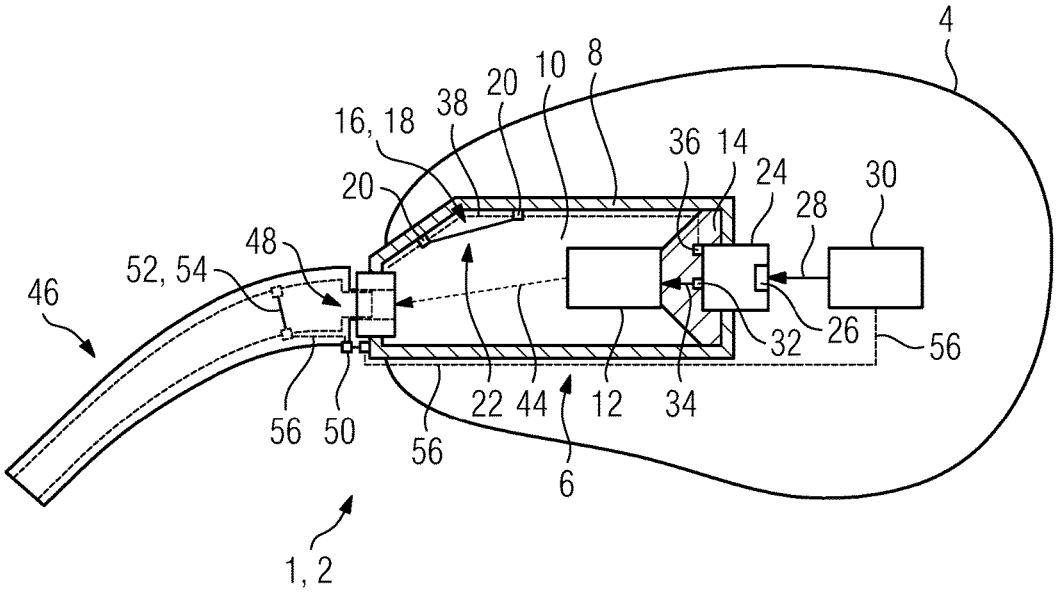
FIG. 2 shows a similar sectional illustration of the hearing device shown in FIG. 1 having an alternative arrangement of the thermo-acoustic transducer.

FIG. 2 shows a sectional illustration of an alternative arrangement of the thermo-acoustic transducer 18 in a hearing device 1 that, apart from the positioning of the thermo-acoustic transducer 18, is already illustrated in FIG. 1. In this case, the thermo-acoustic transducer 18 is arranged not in the sound path 44 for the sound that propagates from the first sound generator 12 to the sound output 40 of the acoustic space 10, but rather to the side of and longitudinally in relation to the sound path 44. In this case, the specific selection of the arrangement can be made dependent on the required dimensioning of the thermo-acoustic transducer 18, particularly of the carbon nanotube film 22, which dimensioning is in turn linked to the desired optimum frequency response of the second sound generator 16.

To complete the illustration, FIG. 2 shows a sound conductor 46, one end of which has a male connector 48. In this case, the male connector 48 is plugged into the rubber connecting piece 42, which produces a vibration-damped mechanical connection between the hearing device 1 and the sound conductor 46. In addition, the sound conductor 46 has a signal port 50 and a third sound generator 52, which, like the second sound generator 16, is likewise in the form of a thermo-acoustic transducer 54. In this case, the signal port 50 is connected to the thermo-acoustic transducer 54, so that a corresponding contact pin on the housing 4 of the hearing device or on the interior housing 8 can be used to produce a signal connection 56 between the thermo-acoustic transducer 54 and the signal processing unit 30.

As an alternative to the illustration shown in FIG. 2, it is also conceivable for the second sound generator that is in the form of a thermo-acoustic transducer to be arranged in the sound conductor, and an appropriate signal connection connects to the signal processing unit directly via contact pins or indirectly—via a high-frequency output of a signal filter. In this case, the first sound generator in the housing of the hearing device generates primarily low-frequency sound that propagates directly into the sound conductor. There, the high-frequency sound is "added" by the thermo-acoustic transducer for a signal having the greatest bandwidth possible converter.

Although the invention has been illustrated and described in more detail by the preferred exemplary embodiment, the invention is not restricted by this exemplary embodiment. Other variations can be derived therefrom by a person skilled in the art without departing from the scope of protection of the invention.

The following is a summary list of reference numerals and the corresponding structure used in the above description of the invention:

1 Hearing device
2 Hearing aid
4 Housing
6 Modular unit
8 Interior housing
10 Acoustic space
12 First sound generator
14 Damping suspension
16 Second sound generator
18 Thermo-acoustic transducer
20 Signal port/terminal
22 Film comprising carbon nanotubes
24 Signal filter, signal splitter
26 Signal input
28 Output signal
30 Signal processing unit
32 Low-frequency output
34 Low-frequency connection
36 High-frequency output
38 High-frequency connection
40 Sound output
42 Rubber connecting piece
44 Sound path
46 Sound conductor
48 Male connector
50 Signal port
52 Third sound generator
54 Thermo-acoustic transducer
56 Signal connection

The invention claimed is:

1. A hearing device, comprising:

a housing;

a signal processing unit disposed in said housing and having an output for carrying an output signal;

an electro-acoustic transducer forming a first sound generator arranged in said housing;

a thermo-acoustic transducer forming a second sound generator, said thermo-acoustic transducer having a plurality of signal ports and at least one film connected to at least one said signal port and formed from carbon nanotubes, and wherein an application of a signal voltage to said signal port brings about time-variant heating in said at least one film and produces a sound by way of a thermo-acoustic effect;

said first and second sound generators being configured to convert an output signal from said signal processing unit into sound;

a frequency filter having a signal input connected to receive the output signal from said signal processing unit, a low-frequency output connected to said first sound generator, and a high-frequency output connected to said second sound generator.

2. The hearing device according to claim 1, wherein said second sound generator is arranged in said housing.

3. The hearing device according to claim 1, wherein said first sound generator is configured to have a higher maximum reproduction level for frequencies in a frequency range up to 4 kHz than for frequencies above 4 kHz.

4. The hearing device according to claim 1, wherein said housing has an acoustic space formed therein with a sound output, said first sound generator is configured to generate sound in said acoustic space, and said second sound generator is arranged in said acoustic space.

5. The hearing device according to claim 4, wherein said second sound generator is arranged in a sound path between said first sound generator and said sound output.

6. The hearing device according to claim 4, wherein said second sound generator is arranged laterally to a of a sound path between said first sound generator and said sound output.

7. The hearing device according to claim 1, configured as a hearing aid.

8. A hearing device, comprising:

a housing;

a signal processing unit disposed in said housing and having an output for carrying an output signal;

a first sound generator arranged in said housing;

a sound conductor reversibly connectable to said housing and having at least one signal port;

a thermo-acoustic transducer forming a second sound generator arranged in said sound conductor, said thermo-acoustic transducer having a plurality of signal ports and at least one film connected to at least one said signal port and formed from carbon nanotubes, and wherein an application of a signal voltage to said signal port brings about time-variant heating in said at least one film and produces a sound by way of a thermo-acoustic effect;

said first and second sound generators being configured to convert an output signal from said signal processing unit into sound;

a frequency filter having a signal input connected to receive the output signal from said signal processing unit, a low-frequency output connected to said first sound generator, and a high-frequency output; and wherein, when said sound conductor is connected to said housing, said at least one signal port of said sound conductor produces a signal connection from said high-frequency output of said frequency filter to said second sound generator.

* * * * *